US007241075B2

(12) United States Patent
Ottesen et al.

(10) Patent No.: US 7,241,075 B2
(45) Date of Patent: Jul. 10, 2007

(54) UMBILICAL ANCHORING CLAMP

(75) Inventors: Torfinn Ottesen, Lokken Verk (NO); Alexander Vogt, Oslo (NO)

(73) Assignee: Nexans, Paris (FR)

( * ) Notice: Subject to any disclaimer, the term of this patent is extended or adjusted under 35 U.S.C. 154(b) by 0 days.

(21) Appl. No.: 11/359,886

(22) Filed: Feb. 21, 2006

(65) Prior Publication Data

US 2006/0204338 A1 Sep. 14, 2006

(30) Foreign Application Priority Data

Feb. 23, 2005 (NO) ..... 20050976

(51) Int. Cl.
*F16L 1/24* (2006.01)

(52) U.S. Cl. ..... 405/172; 405/184.4

(58) Field of Classification Search ..... 405/172, 405/184.4

See application file for complete search history.

(56) References Cited

U.S. PATENT DOCUMENTS 2,373,439 A * 4/1945 Wheatley ..... 405/172
2,518,981 A * 8/1950 Edwards ..... 405/172
2,791,019 A * 5/1957 Du Laney ..... 249/124
3,240,512 A * 3/1966 Pennington et al. ..... 405/172
4,487,230 A * 12/1984 Anthony ..... 204/196.16
4,844,657 A * 7/1989 Ripley et al. ..... 405/184.4
5,603,588 A * 2/1997 Herbert ..... 405/172
5,683,204 A * 11/1997 Lawther ..... 405/172
6,030,145 A 2/2000 Stewart, Jr. et al. ..... 405/172
6,146,052 A 11/2000 Jacobsen et al. ..... 405/169

FOREIGN PATENT DOCUMENTS

WO WO 8911055 A1 * 11/1989

* cited by examiner

*Primary Examiner*—Frederick L. Lagman
(74) *Attorney, Agent, or Firm*—Sofer & Haroun, LLP

(57) ABSTRACT

A subsea cable (3) designed to extend from a floating structure (1) on the sea surface down to a subsea structure (2) on the sea floor with a first portion (3*a*) extending from the floating structure (1) to the sea floor and a second portion (3*b*) laid in or on the sea floor has an outer sheath and cables and/or conduits inside said outer sheath. The second portion (3*b*) of the subsea cable (3) is provided with at least one disc-shaped anchor (4) attached to the subsea cable (3*b*) with clamps. The at least one disc-shaped anchor (4) makes movement of the second portion (3*b*) more difficult.

9 Claims, 2 Drawing Sheets

UMBILICAL ANCHORING CLAMP

RELATED APPLICATION

This application is based on and claims the benefit of priority from Norwegian Patent Application No. 2005 0976, filed on Feb. 23, 2005, the entirety of which is incorporated herein by reference.

FIELD OF THE INVENTION

The present invention relates to a subsea cable comprising an outer sheath and cables and/or conduits inside said outer sheath.

BACKGROUND

Subsea cables of this kind, or umbilicals as they are often called, are widely used in offshore oil and gas recovery. The subsea cable is designed to transport chemicals, hydraulic fluid, electric power and/or electrical control and pilot signals. In particular in those cases where the subsea cable is designed to extend from a floating structure, for example, a ship, on the sea surface down to a subsea structure on the sea floor, it is essential that the cable has a particular course, so that relative movements between the ship and the sea floor do not exert excessively large loads on the cable. To achieve this course it is known to hang weight elements onto parts of the cable whilst other parts of the cable are preferably equipped with floats.

U.S. Pat. No. 6,146,052 discloses a dynamic control cable string or umbilical which hangs in catenary form between a connection point on the seabed and a connection point located at the sea surface. In this case, the cable extends approximately vertically from the ship and then extends in a gentle curve a short distance upwards, in order subsequently in a gentle curve downwards again and finally into an approximately horizontal course at the sea floor.

According to this prior art document, gravity elements are placed on the umbilical with the main purpose of obtaining a submersible section. These gravity elements are only required when the umbilical's own weight is such that the umbilical tends to float or when the unloaden weight is not sufficient to make the umbilical hang in the desired catenary form.

The attached weight elements complicate the deployment operation, leading to increased cost. In addition, the weight elements project from the cable, thus risking to be stuck or be pulled off during the deployment operation. Finally, since the weight elements are designed to obtain a submersible section and not to provide an anchoring effect to the sea floor, the longitudinal stability is not optimal.

To eliminate or greatly reduce the need of attached weight elements it is disclosed in U.S. Pat. No. 6,046,404 that the weight element comprises at least one strength member which extends continuously along the entire length of the cable, to which strength member there is attached a weight element/weight elements.

OBJECTS AND SUMMARY

The main purpose of the present invention is to increase seabed stability of the static section of the subsea cable by restricting longitudinal movements of the umbilical on the seabed and thereby avoiding the need of using excessive length.

According to the invention, this is achieved in that the portion of the subsea cable located in or on the seafloor is provided with at least one disc shaped anchor extending circumferentially around the subsea cable and attached to the subsea cable with clamps. The disc shaped anchors increase the force that keeps the subsea cable in position by having a shoveling effect on the mud or clay on the sea floor, thus finding their way into the sea floor and making movements more difficult.

BRIEF DESCRIPTION OF THE DRAWINGS

Above mentioned and other features and objects of the invention will clearly appear from the following detailed description of embodiments of the invention taken in conjunction with the accompanying drawings where.

DETAILED DESCRITPION

Reference 1 designates a floating structure, by example a ship which is connected with a submerged structure 2 such as wells of an oil field with a subsea cable 3. The subsea cable 3 hangs nearly vertically with a first portion 3*a*, whereas a second portion 3*b* of the subsea cable 3 is laid in or on the sea floor. The first portion 3*a* may of course include a lazy wave.

According to the invention the second portion 3*b* of the subsea cable is provided with a plurality of anchors 4, which are fixed to the surface of the subsea cable. At least the lower portion of the anchors find their way into the sea floor when this is soft as is mud or clay and thereby making movements of the subsea cable more difficult.

Figure 1:
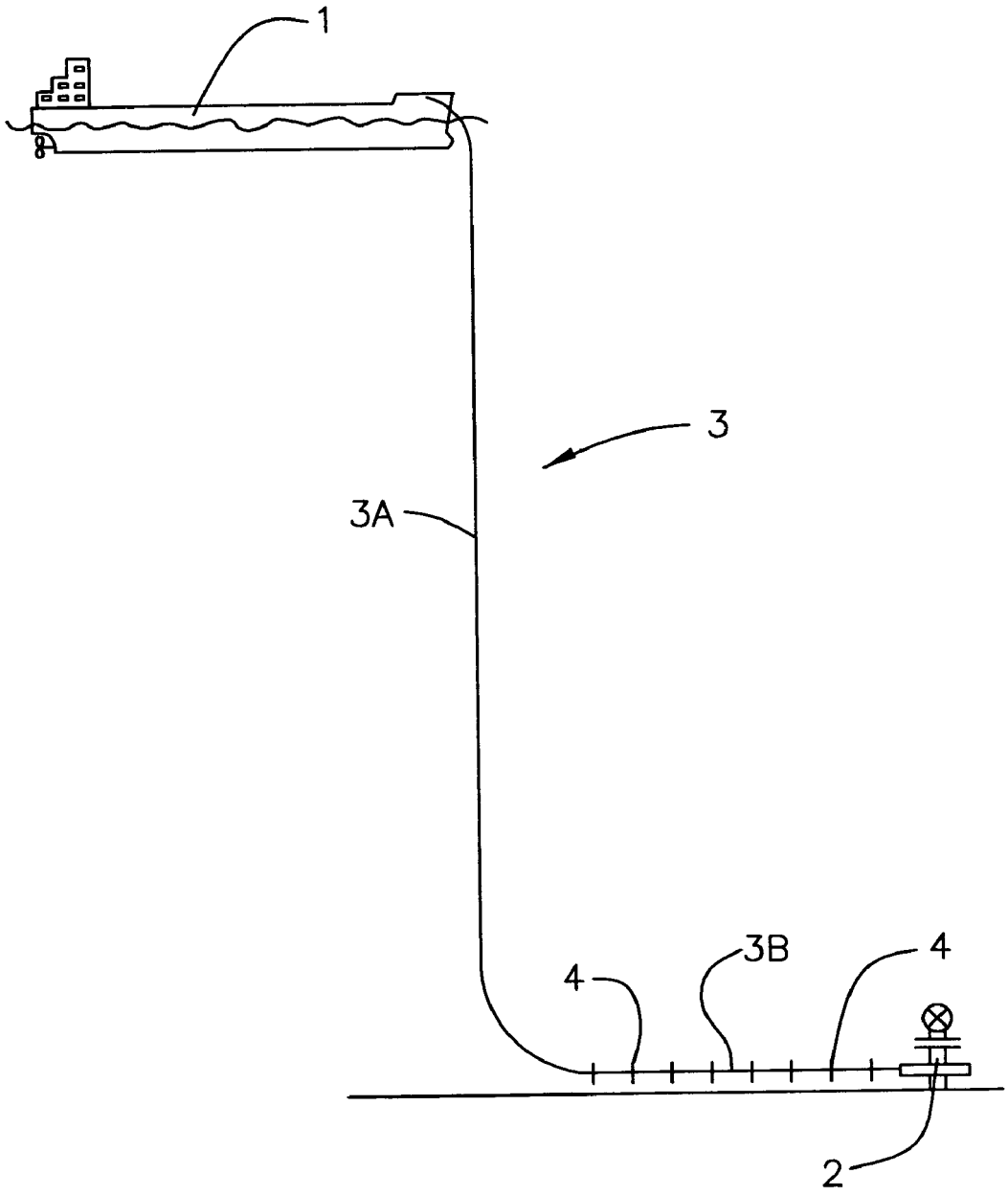
FIG. 1 diametrically shows a device for connecting a ship with a submerged structure.
Figure 2:
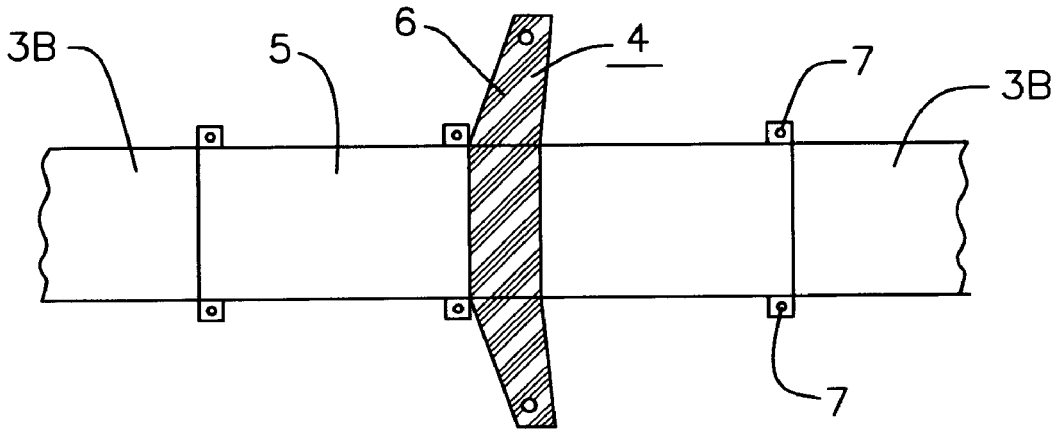
FIG. 2 diametrically shows an anchor according to the invention arranged on a subsea cable.

FIG. 2 shows the anchors 4 fixed to the portion 3*b* of the subsea cable 3 in more detail.

The anchor 4 consists of two half shells of a metal tube 5 to the outer surface of which a disc shaped element 6 is fixed.

The two half shells of the metal tube 5 and the disc shaped element 6 fixed thereto are applied to the surface of the portion 3*b* and clamped by way of splicing plates 7 and screws (not shown).

Figure 3:
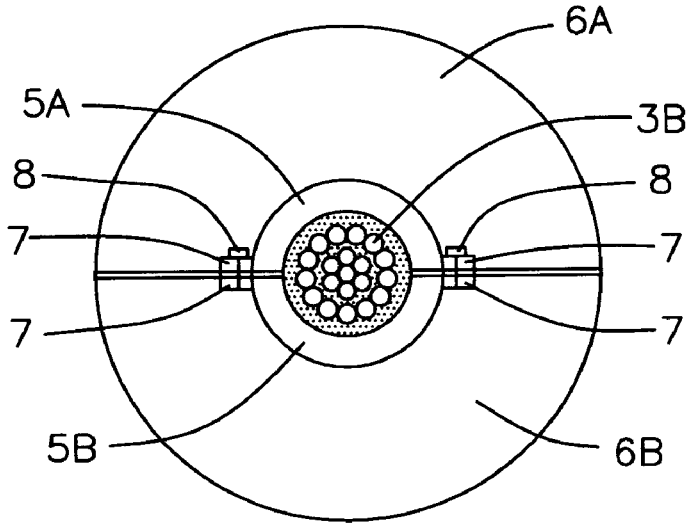
FIG. 3 diametrically shows another view of the anchor shown in FIG. 2.

FIG. 3 shows a view of the anchor in direction of the longitudinal axis of the portion 3*b* of the subsea cable 3.

As can be seen in more detail the metal tube 5 consists of an upper half shell 5*a* and a lower half shell 5*b*. The halves 6*a* and 6*b* of the disc shaped element 6 are fixed to the corresponding half shells 5*a* and 5*b*.

In one embodiment of the invention the halves 6*a* and 6*b* are welded to the half shells 5*a* and 5*b*.

The anchors 4 are applied to the portion 3*b* of the subsea cable 3 during laying of the subsea cable.

The invention claimed is:

1. Subsea cable designed to extend from a floating structure on the sea surface down to a subsea structure on the sea floor comprising:

a first portion extending from the floating structure to the sea floor;

a second portion laid in or on the sea floor, and an outer sheath with cables or conduits inside said outer sheath, wherein the second portion of the subsea cable is provided with at least one disc-shaped element extending circumferentially around the subsea cable and attached to the subsea cable with clamps, wherein each said element is a disc-shaped anchor having a shovelling effect on the sea floor for restricting movements.

2. Subsea cable according to claim 1, wherein that a plurality of disc-shaped anchors are attached to the second portion of the subsea cable.

3. Subsea cable according to claim 1, wherein each anchor has two half shells of a metal tube, to the surface of which at least one disc shaped element is fixed.

4. Subsea cable according to claim 3, wherein the disc shaped element has is made of corrosion proof metal.

5. Subsea cable according to claim 3, wherein the disc shaped element has two halves each of which is welded to one of the half shells.

6. Subsea cable according to one of the claim 1, wherein the half shells are fixed to the sub sea cable by way of splicing plates and screws.

7. Subsea cable according to one of the claim 1, wherein the half shells, the disc-shaped elements the splicing plates and the screws is made of super duplex steel.

8. Subsea cable designed to extend from a floating structure on the sea surface down to a subsea structure on the sea floor comprising:

a first portion extending from the floating structure to the sea floor;

a second portion laid in or on the sea floor, and an outer sheath with cables or conduits inside said outer sheath, wherein the second portion of the subsea cable is provided with at least one disc-shaped anchor extending circumferentially around the subsea cable and attached to the subsea cable with clamps, and wherein each anchor has two half shells of a metal tube, to the surface of which at least one disc shaped element is fixed and in that each disc shaped element is made of corrosion proof metal.

9. Subsea cable designed to extend from a floating structure on the sea surface down to a subsea structure on the sea floor comprising:

a first portion extending from the floating structure to the sea floor;

a second portion laid in or on the sea floor, and an outer sheath with cables or conduits inside said outer sheath, wherein the second portion of the subsea cable is provided with at least one disc-shaped anchor extending circumferentially around the subsea cable and attached to the subsea cable with clamps, and wherein each anchor has two half shells of a metal tube, to the surface of which at least one disc shaped element is fixed and in that the disc shaped element has two halves each of which is welded to one of the half shells.

* * * * *